US008978347B2

(12) United States Patent
Fritsche et al.

(10) Patent No.: US 8,978,347 B2
(45) Date of Patent: Mar. 17, 2015

(54) DEVICE AND METHOD FOR ATTACHING BANDEROLES, SECURITY TAGS, LABEL STRIPS, AND/OR CONTROL STRIPS TO CONTAINERS

(75) Inventors: Claas Fritsche, Dortmund (DE); Lutz Deckert, Gelsenkirchen (DE)

(73) Assignee: KHS GmbH (DE)

( * ) Notice: Subject to any disclaimer, the term of this patent is extended or adjusted under 35 U.S.C. 154(b) by 992 days.

(21) Appl. No.: 12/454,629

(22) Filed: May 20, 2009

(65) Prior Publication Data

US 2009/0282779 A1 Nov. 19, 2009

Related U.S. Application Data

(63) Continuation of application No. 11/461,894, filed on Aug. 2, 2006, now abandoned.

(30) Foreign Application Priority Data

Aug. 3, 2005 (DE) ..... 10 2005 036 938

(51) Int. Cl.
*B65C 1/04* (2006.01)
*B65C 3/20* (2006.01)
*B65C 9/06* (2006.01)

(52) U.S. Cl.
CPC ... *B65C 3/20* (2013.01); *B65C 9/06* (2013.01); *B65C 9/065* (2013.01)
USPC ..... 53/471; 53/253; 53/276; 53/331.5; 53/485; 156/191; 156/215; 156/566

(58) Field of Classification Search
USPC ..... 53/253, 331.5, 317, 319, 428, 431, 471, 53/485, 487, 276, 282, 410; 156/215, 191, 156/487, 566
See application file for complete search history.

(56) References Cited

U.S. PATENT DOCUMENTS

| | | | | |
|---|---|---|---|---|
| 2,129,045 | A | 9/1938 | Carlstein | |
| 3,338,445 | A * | 8/1967 | Lange | 215/254 |
| 4,104,845 | A * | 8/1978 | Hoffmann | 53/410 |
| 4,242,168 | A | 12/1980 | Carter | |
| 4,246,059 | A * | 1/1981 | Hadl | 156/218 |
| 4,928,453 | A | 5/1990 | Ferkany et al. | |
| 4,979,351 | A * | 12/1990 | Harris et al. | 53/415 |
| 5,209,808 | A | 5/1993 | Booth | |

(Continued)

FOREIGN PATENT DOCUMENTS

| | | |
|---|---|---|
| DE | 313749 A | 7/1919 |
| DE | 620972 | 11/1935 |

(Continued)

OTHER PUBLICATIONS

European Search Report EP 1 749 753 and English translation thereof.

*Primary Examiner* — Scott A. Smith
(74) *Attorney, Agent, or Firm* — Nils H. Ljungman & Associates

(57) ABSTRACT

A container handling machine and method of handling containers, in which an attachment arrangement is used to attach an elongated strip, such as a banderole, a security strip, a label strip, or a tax strip, to the removable top of a closed container. Either or both of the container holder and the attachment arrangement which attaches the strips can be rotated in order to place the strip in a particular orientation with respect to the container.

20 Claims, 7 Drawing Sheets

(56) References Cited

U.S. PATENT DOCUMENTS

| | | | | |
|---|---|---|---|---|
| 5,227,005 | A | 7/1993 | Zodrow et al. | |
| 5,411,295 | A * | 5/1995 | Bates et al. | 283/81 |
| 5,713,403 | A | 2/1998 | Cluesserath et al. | |

FOREIGN PATENT DOCUMENTS

| | | | |
|---|---|---|---|
| DE | 2055417 | | 5/1972 |
| DE | 2642046 | | 3/1978 |
| DE | 3507739 | | 4/1986 |
| DE | 3833850 | | 8/1989 |
| DE | 3823471 | | 1/1990 |
| DE | 19508766 | | 9/1996 |
| DE | 20019062 | | 12/2001 |
| DE | 20115480 | | 5/2002 |
| DE | 20309854 | | 9/2003 |
| GB | 360658 | A | 11/1931 |
| RU | 44639 | | 3/2005 |
| SU | 786875 | | 12/1980 |
| SU | 818473 | | 3/1981 |
| SU | 1070066 | | 1/1984 |
| WO | WO 2004/085262 | | 10/2004 |

* cited by examiner

DEVICE AND METHOD FOR ATTACHING BANDEROLES, SECURITY TAGS, LABEL STRIPS, AND/OR CONTROL STRIPS TO CONTAINERS

This application is a continuation of U.S. application Ser. No. 11/461,894, filed on Aug. 2, 2006, now abandoned.

BACKGROUND

1. Technical Field

This application relates to a beverage bottling plant for filling beverage bottles with a liquid beverage, with an information adding station for adding information to the beverage bottles. This application also relates to a method of operating a beverage bottling plant for filling beverage bottles with a liquid beverage, with an information adding station for adding information to the beverage bottles. This application further relates to a device for the application of banderoles, label strips and/or tax labels on containers, whereby the banderoles or label strips are designed to run over the container cap or cover and the adjacent areas of the container neck.

2. Background Information

In beverage bottling plants, the bottles are first filled with a liquid beverage in a filling machine, which is often a rotary filling machine. After the filling process has been completed, the filled beverage bottles are transported or conveyed to a closing machine, which is often a rotary closing machine. The transporting or conveying arrangement can utilize transport star wheels as well as linear conveyors. The closing machine closes the bottles by applying a closure, such as a screw-top cap or a bottle cork, to the bottle mouth. The closed bottles are then usually conveyed to an information adding station, wherein information, such as the product name or the manufacturer's information or logo, is applied to the bottle. The bottles are then sorted and packaged for shipment out of the plant.

In some beverage bottling plants, the information adding station applies banderoles to the beverage bottles. The term "banderoles" as used in this application also means, depending on the individual application, label strips and/or tax labels or tax strips.

Some examples of devices for the application of banderoles to container lids, caps and covers and/or to the neck of the container may be found in the references described in the following.

Devices of this type are described in German Patent Nos. 26 42 046 B2 and 35 07 739 CI, for example.

These devices have a gripper cylinder which is installed above the transport device and with its axis of rotation at a right angle to the longitudinal axis of the container. The gripper cylinder picks up the banderoles from gluing segments, by which the banderoles are supplied with different types of glue.

The gripper cylinder runs with its applicator element tangentially to the container cap or cover and thereby presses the banderoles onto the top of the container cover. Then the banderole is also pressed by applicators against the sides of the neck of the container.

These devices are relatively complex mechanically on account of the gluing segments that are located above the container and the gripper cylinder that rotates above and at a right angle to the containers. The location above and at a right angle to the containers is also problematic because the glue that drips from the gluing segments cannot normally be collected and removed in the same manner as with the horizontal arrangement of the gluing segments and gripper cylinder, which means that dripping glue either falls onto the containers and can thus contaminate the containers and/or the device itself.

German Patent Publication Published for Opposition Purposes No. 20 55 417 describes a device for the application of banderoles over container caps and the adjacent areas of the container neck. The device has a transport carousel with a large number of holding devices that use control cams to grip and hold the containers that are being fed to the process, and an applicator device that applies a banderole to which glue has been applied with a first terminal area to the neck of the container.

Associated with each holding device is an applicator device that has the construction described below: A first applicator is provided which presses the first terminal area of the banderole against the container neck. The opposite, free end of the banderole is simultaneously pressed against an auxiliary pad that lies above the container cap in an extension of the container neck.

This auxiliary pad is fastened to the free end of a pivoting lever which, after the first applicator has performed the first application initiates a downward movement of the pivoting lever, taking with it the upper end of the banderole, and continues until the banderole is moved into an essentially horizontal position, whereby a part of the banderole already comes into contact with the container cap. The horizontally projecting part of the banderole is now applied by means of an additional brushing mechanism that is driven by a movement control system, during which it separates from the auxiliary pad, on the side of the container neck opposite the first applicator.

This applicator device is relatively complicated mechanically, because the movements of the first applicator, the auxiliary pad and of the brushing mechanism must be coordinated and controlled.

U.S. Pat. No. 2,129,045 describes an applicator device for banderoles that works with two symmetrical pivoting arms which are attached to a bell so that they can pivot. For the application of a banderole, this bell is placed on the container cap so that the banderole projects bilaterally beyond the container cap. Then the bell is lowered onto the container cap to first apply the banderole there. Then the two applicators are pivoted toward the two sides of the bell to press the banderole against both sides of the container neck. This device is likewise mechanically quite complicated, because after the application of the banderole to the container cap, first a downward movement of the bell must be effected, and then the pivoting movement of the two applicators must be executed.

A device as described in German Patent Application No. 195 08 766, in which the banderole to which the glue has been applied is attached by a first terminal area of the container neck, whereby the other terminal area of the banderole still projects upward beyond the container cap. Above the container, held by a holding device, is the actual applicator device. This device consists essentially of two applicators which can be moved independently of each other, each by means of a respective curved track and the corresponding sensing elements.

For this purpose, first each applicator which is to the side of the attached banderole is moved toward the container, as a result of which it presses the banderole against the container neck and is simultaneously bent so that the banderole is in contact on the container cover. The second applicator, which is then moved in a like manner, bends the banderole even farther and presses the remaining unattached portion of the banderole against the container neck. One disadvantage with this device is that the bending and application of these banderole are not done optimally.

In particular the application of the banderole by the second applicator sometimes results in faulty applications of the label because the applicator that executes a pivoting movement is generally at an unfavorable angle when it strikes the banderole that generally sticks out from the container at a large angle, which at higher machine outputs and/or when the inside of the applicator is contaminated with glue, can cause the banderole to be crumpled or creased by the applicator and to be applied to the container neck in that condition.

At this point, reference should also be made to the device described in German Patent No. 38 33 850, which according to the object described in its application is designed to press film segments on container necks and caps, but thereby describes components and assemblies that can also be used for the object of this application.

On this device, the following configurations, among others, are worth mentioning here:

- the arrangement of the applicator device above the outlet star wheel of a labeling machine, and
- an applicator element which is supported by a rocker that can be adjusted in an axial plane.

Because the apparatus described in German Patent No. 38 33 850 was designed for an altogether different application, there is no need to describe it further or list its disadvantages here.

As a rule, the only labeling machines that are used for the labeling of banderoles or tax labels or tax strips are those that are realized in the form of rotor machines. As a rule, for this purpose the containers are held in a transport or labeling star wheel 14 which is driven in rotation and are moved forward by the star wheel. Above this star wheel, at intervals and positions corresponding to the individual container (receptacles), a banderole dispenser device is located which delivers the banderoles 13 to the containers 11. The application or the actual fastening of the banderoles 13 to the containers 1 can take place in the second work station, or in a third handling station.

On these machines, the containers 1 to be labeled are delivered or removed by inlet or outlet star wheels, respectively. It is also conventional to have containers delivered from a first transport star wheel to a second transport star wheel. This transfer occurs at the tangent point of the arcs of the participating transport star wheels. To allow this transfer to take place as smoothly as possible, it is absolutely necessary for the containers to move as little as possible into the circular contour of the transport star wheels. In this regard, it has been determined that it is particularly advantageous to transport the containers through the labeling machine and through the transport star wheels in an orientation such that the smaller of the two dimensions of the container "length" and "width" always points toward the center of the transport star wheels, while the larger of the two diameters is oriented in the tangential direction with regard to the transport star wheels.

Any other orientation of the containers would require specially shaped receptacle pockets with a significant undercutting of the flanks. Configurations of this type have not been widely used in actual practice, and in all of the labeling machines of the prior art, the containers are transported through the labeling machine in the orientation described first above.

Starting from the conventional orientation of the containers in the labeling machine and the transport star wheels, the following portion of this description assumes that the containers are transported with their transverse side facing forward.

A closer consideration of the devices of the prior art for the application of banderoles to the container neck or cap shows that one thing common to all the devices of the prior art is that they are only capable of applying these banderoles in a defined, unchangeable orientation with respect to the container transport direction on the containers.

For example, some manufacturers only produce devices of the prior art that attach the banderole essentially parallel to the transport device, i.e. in the direction of the longitudinal side of the containers. Other manufacturers of devices of the prior art only produce devices that apply the banderole essentially at a right angle to the direction of transport, i.e. in the transverse direction of the container.

On the other hand, the prior art does not include any devices that make possible the optional labeling of a container in either orientation.

If plans then call for the application of tax labels or tax strips to expensive alcoholic beverages, for example, consideration must also be given to the fact that these beverages are frequently not bottled in rotationally symmetrical bottles, but quite often are packaged in molded bottles that are not rotationally symmetrical.

Consequently, the user of labeling machines of this type is forced to purchase its labeling machine from a manufacturer that applies banderoles 13 on all relevant bottles in the same orientation with respect to the longitudinal direction of the container, regardless of whether, for example, a different orientation might be desirable from the customer's point of view or in line with aesthetic aspects.

This fact is generally perceived to be a disadvantage in practice.

What is meant by rotationally symmetrical, according to at least one possible embodiment, is that the container or bottle, when viewed from above along the central vertical axis of the bottle, which central vertical axis is disposed to run through the center of the mouth and neck of the bottle, has uniform radial dimensions extending from the central axis. For example, most beverage bottles, about their outermost periphery, have a cylindrical profile when viewed from above. Such cylindrical bottles may be rotated about their central vertical axis and will always appear, when viewed from above, to be in exactly the same rotational position as before any rotation was performed. On the other hand, bottles or containers that are not rotationally symmetrical are bottles that have a length dimension and a width dimension when viewed from above, which length dimension is greater than the width dimension. For example, a bottle that is not rotationally symmetrical may have a profile that appears to be oval-shaped or rectangular when viewed from above. When such a bottle is rotated, for example, 90 degrees, the length dimension is now perpendicular or substantially perpendicular to its original position before rotation. The view from above has therefore been altered by a rotation of 90 degrees, and thus does not present essentially the same view as before rotation. Any rotation, such as, for example, a 45, 60, or 90 degree rotation, about the central vertical axis of a bottle that is not rotationally symmetrical will produce a view that is different from the original. Even a 180 degree rotation may not produce the same view if one end, side, or half of the bottle, along, for example, the length dimension is different from the opposite end, side, or half, as those ends, sides, or halves would be flipped.

As a result,

OBJECT

An object of at least one possible embodiment is to create a device for the application of banderoles and/or tax labels or tax strips to container necks and/or container caps that is as mechanically simple as possible, is as little susceptible to disruption as possible and can be operated at a high output capacity, whereby the orientation of the banderoles can be selected as desired with respect to the geometry of the container.

SUMMARY

At least one possible embodiment teaches that the containers and the device to transfer the banderoles to the containers are realized so that they can be moved in relation to each other.

Other possible embodiments are explained in greater detail below with reference to two exemplary embodiments.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

FIG. 1A shows a beverage bottling plant according to at least one possible embodiment;

DESCRIPTION OF EMBODIMENT OR EMBODIMENTS

Figure 1:
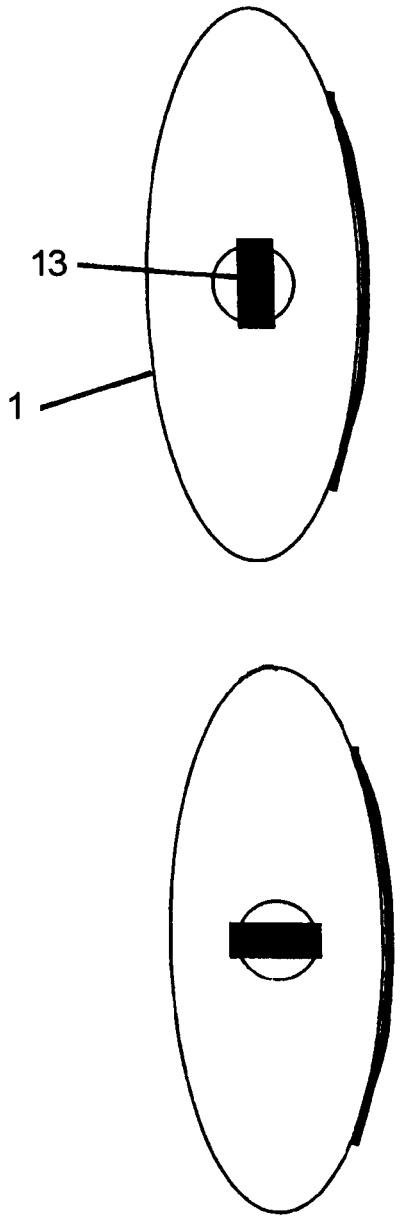
FIG. 1 is a simplified overhead view of banderoles applied to two containers, whereby these banderoles are attached in different orientations with respect to the longitudinal axis of the container.
Figure 2:
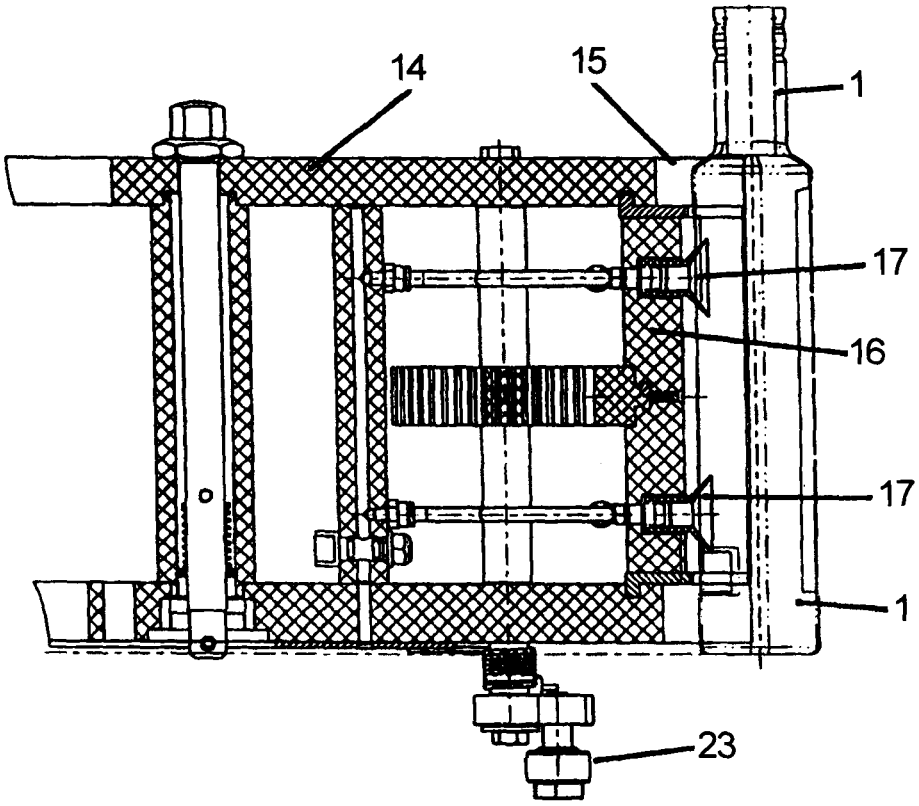
FIGS. 2 and 3 illustrate one exemplary embodiment, in which the containers are movable with respect to the banderole transport device.
Figure 3:
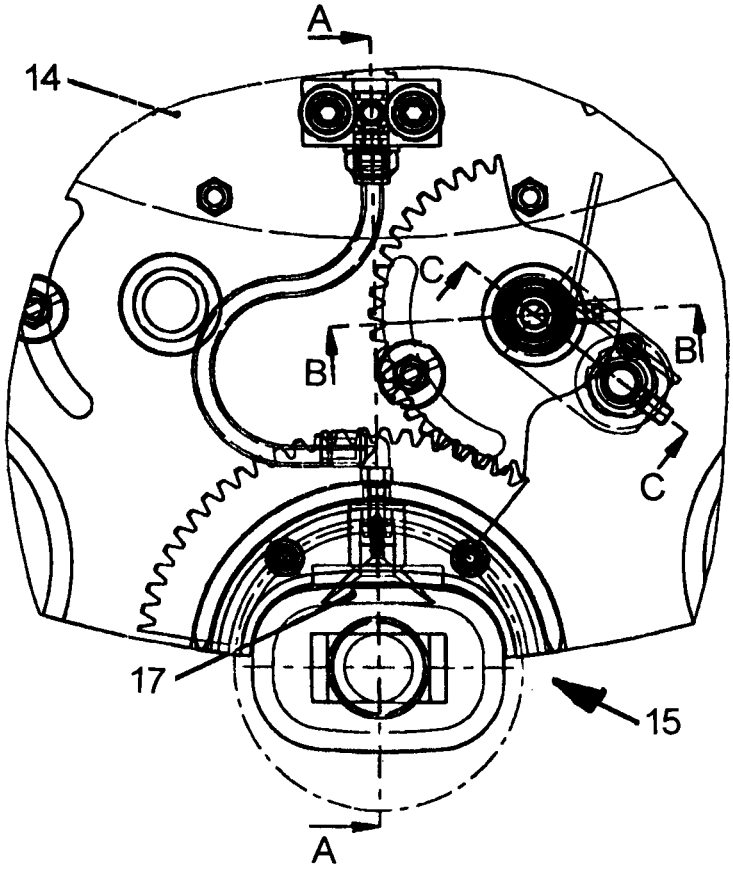

Developments, advantages and potential applications of at least one possible embodiment will become apparent on the basis of the following description of the exemplary embodiments and of the accompanying drawing. All the characteristics described and/or illustrated are the object or objects of the invention, individually or in any possible combination, regardless of their placement in the claims or the references between claims. The text of the claims is simultaneously incorporated by reference into the description.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. In at least one possible embodiment, the closing station 106 is designed to place corks in the bottles B to close them. The beverage bottle closing arrangement or closing station 106 can be connected by a third conveyer arrangement 107 to a beverage bottle information adding station 108. The third conveyor arrangement may be formed, for example, by a plurality of starwheels, or may also include a linear conveyor device.

In the illustrated embodiment, the beverage bottle information adding station 108, which could be a labeling arrangement, has at least one information adding unit, device, or module, for adding information to bottles B. In the embodiment shown, the information adding station 108 has an information adding device 115 which adds information to the bottles in the form of banderoles, tax labels, or label strips to the tops of the bottles B. The information adding device 115 can perform an adjustment movement of the banderoles and/or the bottles B in order to permit the placement of the banderoles in different positions on the bottles B, which bottles B have an essentially non-cylindrical outer profile, such as an elliptical or a rectangular shape, when viewed from above along the central vertical axis of the bottles B. In this manner the banderoles may be oriented such that they are positioned essentially parallel, essentially perpendicular, or at an angle with respect to either the length or width dimension of the bottles B. Also in the embodiment shown, the information adding station 108 has three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the information adding station 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

To illustrate the situation, FIG. 1 shows, in an overhead view, two containers 1, whereby the banderole 13 is applied in each case in a different orientation with respect to the longitudinal axis of the container.

In the context of this application, the term "movable" means the ability of an object to execute a pivoting or rotational movement, which is called an adjustment movement below, around the vertical axis of the object in question. This adjustment movement is thereby executed mechanically or electro-mechanically by defined angular amounts and is either controlled or regulated with an open loop or a closed loop.

In a first configuration, the container 1 can be moved with respect to the stationary, non-adjustable labeling assemblies.

In this regard, it is advantageous to equip the receptacle pockets 15 of the transport or label star wheel 14 with a holding element 16 which holds the containers, fixes them with a gripper or holding device 17 and which can thereby also move around its vertical axis.

The sequence of operations of a device according to at least one possible embodiment is as follows: In a delivery position, the container 1 is transferred to the transport or labeling star wheel 14, where it is held in a receptacle pocket 15 or in the holding element 16 that is located in this receptacle pocket.

Inside this holding element 16, the container 1 is grasped by a suitable gripping or clamping device 17, such as clamp or vacuum grippers, for example, and fixed in position with respect to the holding element 16.

Then the holding element 16, and with it the fixed container 1, is moved around its vertical axis. When this movement has been completed, the banderole 13 can be applied in any desired orientation to the longitudinal side of the container in a known manner.

As shown in the illustrated exemplary embodiment, the rotational motion around the vertical axis can be controlled by a curved track control mechanism, whereby a drag lever 23 follows a closed cam with a groove and transmits its movements directly or indirectly to the holding element 16.

As a result of the use of a device according to at least one possible embodiment, the currently fixed orientation of the banderole 13 with respect to the longitudinal side of the container can be modified easily. As a result of the selection of a suitable control cam, the realization of movement angles other than 90 degrees is possible, so that it also becomes possible to apply banderoles 13 at an angle of 45 degrees, for example, with respect to the longitudinal side of the container.

However, this rotational movement can be realized in many other ways, such as for example by the use of computer-controlled servomotors, synchronous motors or stepper motors, whereby the rotational position of the holding element 16 in relation to the rotational position of the transport or labeling star wheel 14 is preferably specified by an associated computer device and monitored by means of suitable sensors.

As a result of this method, the comparatively complex and expensive curved track control system can be eliminated, and adjustments to modified sequences of movement with arbitrary adjustment angles can be significantly simplified.

In an additional configuration, instead of the holding elements 16 that receive the containers 1, the device for the application of the banderoles 13 can be adjusted around its vertical axis.

Figure 4:
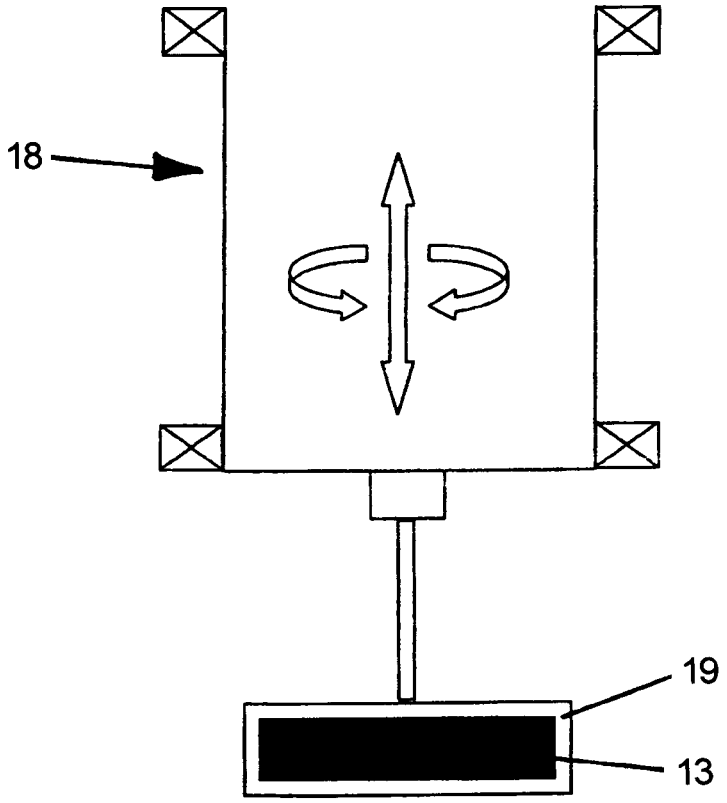
FIGS. 4, 5 and 6 illustrate an additional embodiment, in which the banderole transport device is movable with respect to the containers.
Figure 5:
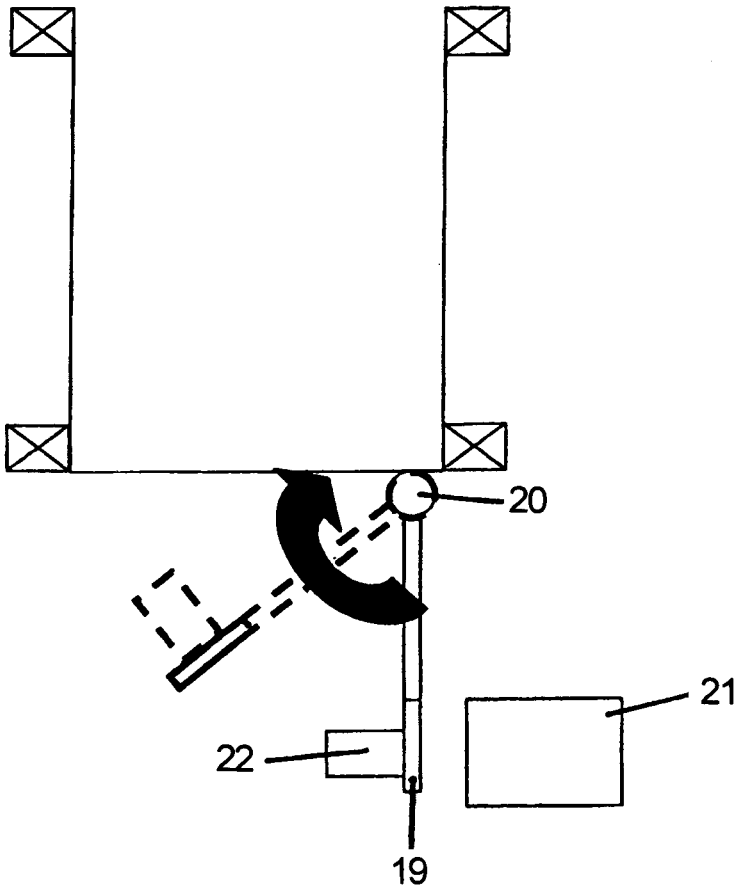
Figure 6:
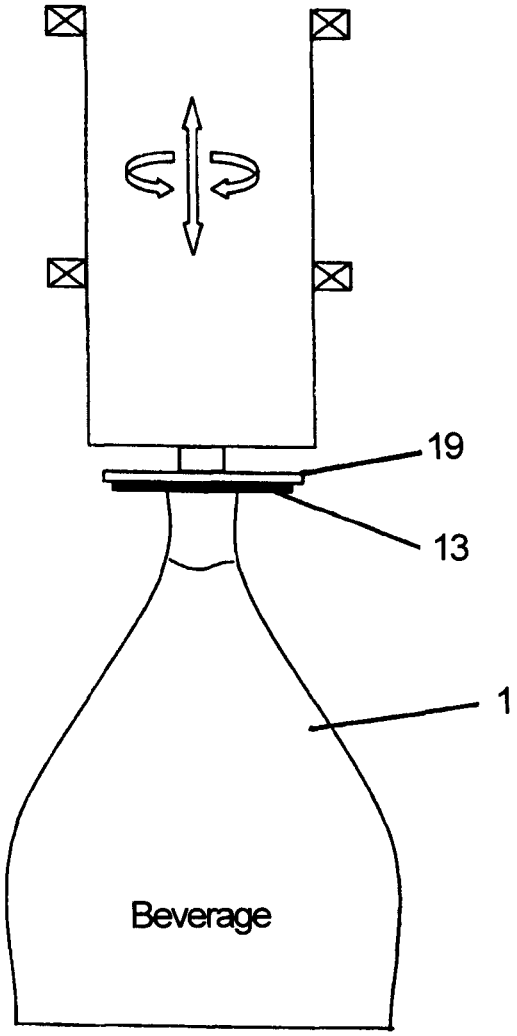

A corresponding exemplary embodiment is illustrated in FIGS. 4, 5 and 6.

Figure 7:
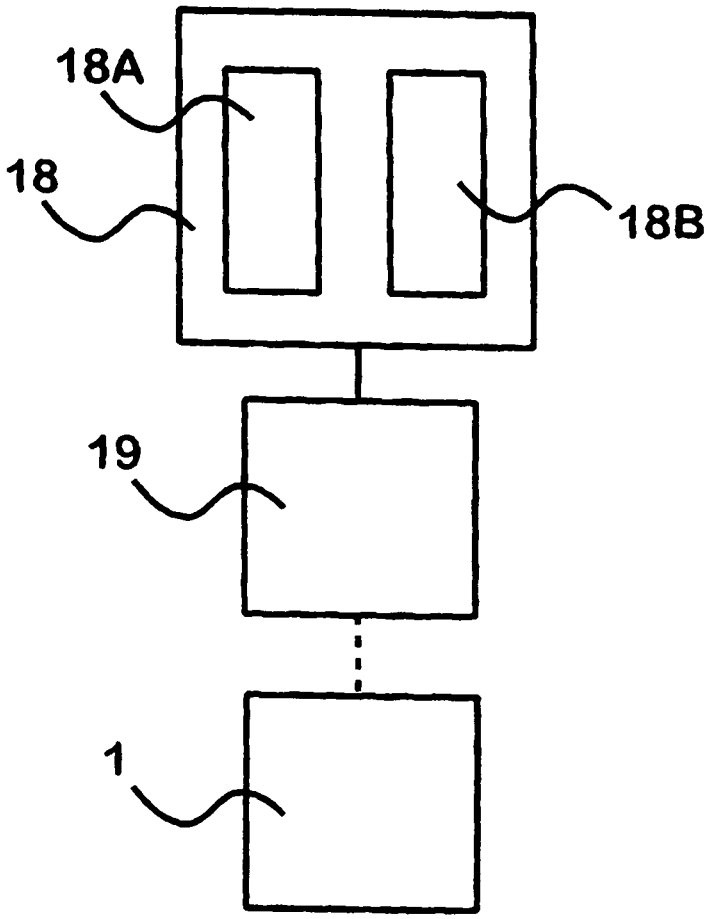
FIG. 7 shows a box diagram of an information adding device according to at least one possible embodiment.

The banderole delivery device 18 that is located above the container 1 can be adjusted around its vertical axis and can also be raised and lowered in the direction of this vertical axis. As can be seen in FIG. 7, the information adding device 18, in the embodiment shown, has two drive mechanisms or motors 18A and 18B. The first drive mechanism 18A executes a rotational movement of the information adding device 18 about a central vertical axis, and the second drive mechanism 18B executes a linear, vertical movement up and down.

On its lower end, the banderole delivery device 18 has a banderole receptacle 19, which can pivot around an axis of rotation 20, and can therefore be placed in a vertical banderole receiving position and a horizontal banderole dispensing position. As can also be seen in FIG. 7, the receptacle 19 is connected to the information adding device 18. The information adding device 18, in at least one possible embodiment, can be rotated about its central vertical axis to orient the receptacle 19 with respect to the bottle 1. Once the appropriate or desired orientation has been achieved, the information adding device 18 is moved vertically downward to apply an information strip or label to the top of the container or bottle 1.

For the loading of the banderoles 13, the banderole receptacle 19 moves into the vertical banderole take-over position. In this position, the banderole receptacle 19 receives the banderole 13 from a banderole dispensing device.

For the processing of banderoles 13 and cold glue, this device can be a glue pad or glue segments of the prior art. For the processing of self-adhesive banderoles, the banderole dispensing device 21 can be, for example, the banderole or self-adhesive label dispensing edge.

A fixing device 22 for fixing the banderoles 13 that have been taken over can advantageously be associated with the banderole receptacle 19. This fixing device can be, for example, mechanically acting gripper elements or a vacuum gripper.

If the banderole 13 is taken over and fixed by the banderole receptacle 19, the banderole receptacle 19 pivots out of the vertical banderole delivery position into the horizontal banderole dispensing position.

In this position, the banderole is preferably positioned centrally on the underside of the banderole transfer device 18.

The banderole delivery device is subsequently displaced around its vertical axis by an angle such that the banderole 13 held on its underside has the desired orientation with respect to the longitudinal side of the container 1.

The displacement movement of the banderole transfer device 18 can take place in a manner comparable to that in the exemplary embodiment described above.

Once the desired orientation of the banderole 13 has been reached, the banderole transfer device 18 moves in the direction of its principal axis into a position in which the banderole 13 can be transferred to the container 1. After the delivery of the banderole 13, the banderole transfer device 18 returns to its starting position.

In another additional configuration, both the banderole transfer device 18 as well as the container 1 can execute displacement movements in and/or around their longitudinal axis.

In the context of this application, the term "container" is used to mean all types of containers for holding products such as beverages, foods, hardware, pharmaceuticals etc., such as bottles, cans, jars with and without a screw top, canisters etc. The term "container" is used below for purposes of simplification.

The invention relates to a device for the application of banderoles, tamper-evident labels, label strips and/or tax labels or tax strips to containers, whereby the labels are applied to the container cap and/or adjacent areas of the container neck, whereby the containers and the device for the transfer of the banderoles to the containers are movable with respect to one another.

One feature or aspect of an embodiment is believed at the time of the filing of this patent application to possibly reside broadly in a device for the application of banderoles (13), tamper-evident labels, label strips and/or tax labels or tax strips to containers (1), whereby these labels are applied to the container cap and/or adjacent areas of the container neck, characterized in that the containers (1) and the device for the transfer of the banderoles (13) to the container (1) can be moved in relation to one another.

Another feature or aspect of an embodiment is believed at the time of the filing of this patent application to possibly reside broadly in a device, characterized in that the containers (1) and the device for the transfer of banderoles (13) can be moved angularly with respect to one another around their common vertical axis.

Yet another feature or aspect of an embodiment is believed at the time of the filing of this patent application to possibly reside broadly in a device, characterized in that the containers can be moved with respect to the banderole transfer device which cannot be moved.

Still another feature or aspect of an embodiment is believed at the time of the filing of this patent application to possibly reside broadly in a device, characterized in that the banderole transfer device can be moved with respect to the containers which cannot be moved.

A further feature or aspect of an embodiment is believed at the time of the filing of this patent application to possibly reside broadly in a device, characterized in that the banderole transfer device and the containers are movable.

Another feature or aspect of an embodiment is believed at the time of the filing of this patent application to possibly reside broadly in a device, characterized in that the adjustment movement takes place by means of the cam mechanism.

Yet another feature or aspect of an embodiment is believed at the time of the filing of this patent application to possibly reside broadly in a device, characterized in that the displacement movement is executed with the assistance of servomotors, synchronous motors and stepper motors, whereby the adjustment movement takes place with an open-loop or closed-loop control.

Still another feature or aspect of an embodiment is believed at the time of the filing of this patent application to possibly reside broadly in a method for the application of banderoles (13), tamper-evidence labels, label strips and/or tax labels or tax strips on containers (1), whereby these strips are attached to the container cap and/or adjacent areas of the container neck, characterized in that the containers (1) are transferred to a transport or label star wheel (14), which then moves the containers (1) and/or the banderole transfer device so that the banderoles (13) are subsequently transferred to the container (1), and the banderoles (13) are then applied to the container (1).

The components disclosed in the various publications, disclosed or incorporated by reference herein, may possibly be used in possible embodiments of the present invention, as well as equivalents thereof.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

The appended drawings in their entirety, including all dimensions, proportions and/or shapes in at least one embodiment of the invention, are accurate and are hereby included by reference into this specification.

Some examples of open-loop control systems that may possibly be utilized or possibly adapted for use in at least one possible embodiment of the present application may possibly be found in the following U.S. patents: U.S. Pat. No. 5,770,934 issued to Theile on Jun. 23, 1998; U.S. Pat. No. 5,210,473 issued to Backstrand on May 11, 1993; U.S. Pat. No. 5,320,186 issued to Strosser et al. on Jun. 14, 1994; and U.S. Pat. No. 5,369,342 issued to Rudzewicz et al. on Nov. 29, 1994.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of closed-loop control circuits that may possibly be utilized or possibly adapted for use in at least one possible embodiment of the present application may possibly be found in the following U.S. patents: U.S. Pat. No. 5,770,934 issued to Theile on Jun. 23, 1998; U.S. Pat. No. 5,189,605 issued to Zuehlke et al. on Feb. 23, 1993; U.S. Pat. No. 5,223,072 issued to Brockman et al. on Jun. 29, 1993; and U.S. Pat. No. 5,252,901, issued to inventors Ozawa et al. on. Oct. 12, 1993.

All, or substantially all, of the components and methods of the various embodiments may be used with at least one embodiment or all of the embodiments, if more than one embodiment is described herein.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

All of the patents, patent applications and publications recited herein, and in the Declaration attached hereto, are hereby incorporated by reference as if set forth in their entirety herein.

Some examples of synchronous motors which may possibly be utilized or adapted for use in at least one possible embodiment may possibly be found in the following U.S. patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of rotation sensors that may possibly be utilized or possibly adapted for use in at least one possible embodiment of the present application may possibly be found in the following U.S. patents: U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of position sensors or position sensor systems that may be used or adapted for use in at least one possible embodiment of the present invention may be found in the following U.S. patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of centering devices for bottle handling devices which may possibly be utilized or adapted for use in at least one possible embodiment may possibly be found in Federal Republic of Germany Application No. DE P 103 14 634, entitled "Spulbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004. The above applications are hereby incorporated by reference as if set forth in their entirety herein.

All of the patents, patent applications or patent publications, which were cited in the first examination report for the corresponding foreign application, namely, Federal Republic of Germany Patent Application No. 10 2005 036 398.9, and/or cited elsewhere are hereby incorporated by reference as if set forth in their entirety herein as follows: DE 620 972 C; DE 203 09 854 U1; U.S. Pat. No. 5,209,808; and WO 2004/085262 A1.

The corresponding foreign application, namely, Federal Republic of Germany Patent Application No. 10 2005 036 398.9, filed on Aug. 3, 2005, having inventors Claas FRITSCHE and Lutz DECKERT, and DE-OS 10 2005 036 398.9 and DE-PS 10 2005 036 398.9, are hereby incorporated by reference as if set forth in their entirety herein for the purpose of correcting and explaining any possible misinterpretations of the English translation thereof. In addition, the published equivalents of the above corresponding foreign patent publication application, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of bottling and container handling systems and components thereof which may possibly be utilized or adapted for use in at least one possible embodiment, may possibly be found in the following U.S. patents: U.S. Pat. No. 7,065,938, entitled "Beverage bottling plant for filling bottles with a liquid beverage filling material, and a container filling plant container information adding station, such as, a labeling station having a gripper arrangement, configured to add information to containers, such as, bottles and cans"; U.S. Pat. No. 7,062,894, entitled "Beverage bottling plant for filling bottles with a liquid beverage filling material, and a container filling plant container information adding station, such as, a labeling station having a sleeve label cutting arrangement, configured to add information to containers, such as, bottles and cans"; U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations"; U.S. Pat. No. 7,010,900, entitled "Beverage bottling plant for filling bottles with a liquid beverage filling material, and a cleaning device for cleaning bottles in a beverage bottling plant"; U.S. Pat. No. 6,971,219, entitled "Beverage bottling plant for filling bottles with a liquid beverage filling material and a labelling station for labelling filled bottles and other containers"; U.S. Pat. No. 6,918,417, entitled "Beverage bottling plant for filling bottles with a liquid beverage filling material, and an easily cleaned lifting device in a beverage bottling plant"; and U.S. Pat. No. 6,901,720, entitled "Beverage bottling plant for filling bottles with a liquid beverage filling material, and apparatus for attaching carrying grips to containers with filled bottles."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into. Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of bottling and container handling systems and components thereof which may possibly be utilized or adapted for use in at least one possible embodiment, may possibly be found in the following U.S. patent applications: Ser. No. 10/653,617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004; Ser. No. 10/954,012, filed on Sep. 29, 2004; Ser. No. 10/952,706; Ser. No. 10/962,183, filed on Oct. 8, 2004; Ser. No. 10/967,016, filed on Oct. 15, 2004; Ser. No. 10/982,706, filed on Nov. 5, 2004; Ser. No. 10/982,694; Ser. No. 10/982,710; Ser. No. 10/984,677, filed on Nov. 9, 2004; Ser. No. 10/985,640, filed on Nov. 10, 2004; Ser. No. 11/004,663, filed on Dec. 3, 2004; Ser. No. 11/009,551, filed on Dec. 10, 2004; Ser. No. 11/012,859, filed on Dec. 15, 2004; Ser. No. 11/014,673, filed on Dec. 16, 2004; Ser. No. 11/016,364, filed on Dec. 17, 2004; and Ser. No. 11/016,363.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A container handling machine comprising:

a container holding arrangement comprising a plurality of container holders configured to receive and hold containers that are not rotationally symmetrical;

an attachment arrangement being configured to attach an elongated strip comprising one of: a banderole, a security strip, a label strip, and a tax strip, to a closed container by attaching a portion of the strip to a removable container top and at least one other portion of the strip to the container neck area;

at least one of (A) and (B):

(A) each of said container holders being configured to rotate a container held thereby about a vertical container axis to orient the container in a desired orientation with respect to an elongated strip to be attached to the container; and (B) said attachment arrangement being configured to rotate about its axis to orient an elongated strip to be attached to a container in a desired orientation with respect to the container.

2. The container handling machine according to claim 1, wherein only said container holders are rotatable.

3. The container handling machine according to claim 2, further comprising a control arrangement being configured to effect and control rotational movement of said container holders, wherein said control arrangement comprises one of: servo motors, synchronous motors, stepping motors, and a cam arrangement.

4. The container handling machine according to claim 1, wherein only said attachment arrangement is rotatable.

5. The container handling machine according to claim 4, further comprising a control arrangement being configured to effect and control rotational movement of said attachment arrangement, wherein said control arrangement comprises one of: servo motors, synchronous motors, stepping motors, and a cam arrangement.

6. The container handling machine according to claim 1, wherein at least said attachment arrangement is rotatable.

7. The container handling machine according to claim 6, wherein said container holders are rotatable and said attachment arrangement is rotatable.

8. The container handling machine according to claim 7, wherein:

each of said container holders is configured to position a container such that the container and said attachment arrangement are coaxial; and said attachment arrangement is configured to move axially toward a removable container top to attach a strip thereto.

9. The container handling machine according to claim 8, wherein said attachment arrangement is configured to initially attach a strip to a removable container top in a position in which the strip is essentially perpendicular to the rotational axis of the container.

10. The container handling machine according to claim 9, wherein said attachment arrangement is configured to initially attach a central, adhesive portion of a strip to a removable container top.

11. A method of operating a container handling machine comprising the steps of:

holding containers with a container holding arrangement comprising a plurality of container holders configured to receive and hold containers that are not rotationally symmetrical;

moving containers that are not rotationally symmetrical with said container holding arrangement to an attachment arrangement being configured to attach an elongated strip comprising one of: a banderole, a security label, a label strip, and a tax strip, to a closed container;

at least one of (A) and (B):

(A) rotating a container holder and thereby rotating a container held thereby about a vertical container axis, and thereby orienting said container in a desired orientation with respect to an elongated strip to be attached to said container; and (B) rotating said attachment arrangement about its axis and thereby orienting an elongated strip to be attached to a container in a desired orientation with respect to said container;

attaching said strip to said container by attaching a portion of said strip to a removable container top.

12. The method according to claim 11, wherein only step (A) is performed to angularly move said container with respect to said strip.

13. The method according to claim 11, wherein only step (B) is performed to angularly move said strip with respect to said container.

14. The method according to claim 11, wherein both steps (A) and (B) are performed to relatively angularly move said strip and said container with respect to one another.

15. The method according to claim 14, wherein, after said strip is attached to said removable container top, pressing a second portion of said strip to a first side of a container neck area, and pressing a third portion of said strip to a second side of said container neck area opposite said first side.

16. The method according to claim 15, wherein said step of attaching said strip comprises attaching said strip essentially perpendicular to the rotational axis of said first container and at a first angular orientation, and then repeating said attaching step for a second strip of a second container, wherein said second strip is oriented at a second angular orientation different from said first angular orientation.

17. The method according to claim 11, wherein said step of attaching said strip comprises pressing an adhesive portion of said strip onto said removable container top.

18. The method according to claim 17, wherein, after said strip is attached to said removable container top, pressing a second portion of said strip to a first side of a container neck area, and pressing a third portion of said strip to a second side of said container neck area opposite said first side.

19. The method according to claim 18, wherein said step of attaching said strip comprises attaching said strip essentially perpendicular to the rotational axis of said first container and at a first angular orientation, and then repeating said attaching step for a second strip of a second container, wherein said second strip is oriented at a second angular orientation different from said first angular orientation.

20. The method according to claim 11, wherein said step of attaching said strip comprises attaching said strip essentially perpendicular to the rotational axis of said first container and at a first angular orientation, and then repeating said attaching step for a second strip of a second container, wherein said second strip is oriented at a second angular orientation different from said first angular orientation.

* * * * *

UNITED STATES PATENT AND TRADEMARK OFFICE

CERTIFICATE OF CORRECTION

PATENT NO. : 8,978,347 B2
APPLICATION NO. : 12/454629
DATED : March 17, 2015
INVENTOR(S) : Claas Fritsche et al.

It is certified that error appears in the above-identified patent and that said Letters Patent is hereby corrected as shown below:

On the Title Page

Please replace the application number in Item (30) Foreign Application Priority Data with the following correct application number: -- 10 2005 036 398 --.

Signed and Sealed this
Fourteenth Day of July, 2015

Michelle K. Lee

Michelle K. Lee
*Director of the United States Patent and Trademark Office*